US010578291B1

(12) United States Patent
Walma, Jr.

(10) Patent No.: US 10,578,291 B1
(45) Date of Patent: Mar. 3, 2020

(54) UTILIZATION OF LIGHTING POWER INFRASTRUCTURE

(71) Applicant: Cooper Technologies Company, Houston, TX (US)

(72) Inventor: Kenneth Dale Walma, Jr., Peachtree City, GA (US)

(73) Assignee: Eaton Intelligent Power Limited, Dublin (IE)

( * ) Notice: Subject to any disclaimer, the term of this patent is extended or adjusted under 35 U.S.C. 154(b) by 167 days.

(21) Appl. No.: 15/667,450

(22) Filed: Aug. 2, 2017

Related U.S. Application Data

(60) Provisional application No. 62/371,072, filed on Aug. 4, 2016.

(51) Int. Cl.

| | |
|---|---|
| ***F21V 23/02*** | (2006.01) |
| ***F21V 23/06*** | (2006.01) |
| ***F21V 21/04*** | (2006.01) |
| ***F21S 8/02*** | (2006.01) |
| ***F21Y 115/10*** | (2016.01) |

(52) U.S. Cl.
CPC ..... *F21V 23/02* (2013.01); *F21S 8/02* (2013.01); *F21V 21/04* (2013.01); *F21V 23/06* (2013.01); *F21Y 2115/10* (2016.08)

(58) Field of Classification Search
CPC ..... F21V 23/06; F21V 23/02; F21V 23/009; F21V 21/04; F21S 8/02; F21S 8/04
USPC ..... 362/147, 148, 150
See application file for complete search history.

(56) References Cited

U.S. PATENT DOCUMENTS

| | | | | |
|---|---|---|---|---|
| 7,587,289 | B1 * | 9/2009 | Sivertsen | F21K 9/00 362/147 |
| 8,558,413 | B1 * | 10/2013 | Lepard | F21V 33/0052 307/150 |
| 10,253,959 | B2 * | 4/2019 | Brown | F21S 8/026 |
| 10,290,265 | B2 * | 5/2019 | Kumar | G09G 3/3413 |
| 2003/0199183 | A1 * | 10/2003 | Wangenheim | H01R 13/717 439/100 |
| 2006/0209530 | A1 * | 9/2006 | Schaak | F21S 6/003 362/86 |
| 2007/0008710 | A1 * | 1/2007 | Nielson | F21S 2/00 362/20 |
| 2007/0285053 | A1 * | 12/2007 | Noguchi | H02J 7/32 320/114 |
| 2008/0150480 | A1 * | 6/2008 | Navid | H01R 31/06 320/113 |
| 2008/0258642 | A1 * | 10/2008 | Patel | F21S 6/002 315/246 |
| 2009/0154148 | A1 * | 6/2009 | Meyer | F21L 2/00 362/157 |
| 2011/0084651 | A1 * | 4/2011 | Caskey | H01R 25/006 320/107 |
| 2011/0305056 | A1 * | 12/2011 | Chien | F21S 8/035 363/178 |
| 2012/0294015 | A1 * | 11/2012 | Smed | F21S 6/003 362/382 |

(Continued)

*Primary Examiner* — William N Harris
(74) *Attorney, Agent, or Firm* — King & Spalding LLP

(57) ABSTRACT

A lighting module includes an LED light source and a power source coupled to the LED light source. The LED light source is powered by the power source. The power source includes an auxiliary output connection that is terminated at a standardized connector. The power source provides power to an auxiliary device via the standardized connector.

20 Claims, 6 Drawing Sheets

(56) References Cited

U.S. PATENT DOCUMENTS

| | | | | |
|---|---|---|---|---|
| 2015/0016114 | A1* | 1/2015 | Marquardt | F21V 21/26 362/253 |
| 2016/0097522 | A1* | 4/2016 | Chien | F21V 33/00 362/183 |
| 2017/0023193 | A1* | 1/2017 | Thosteson | H05B 37/0272 |
| 2017/0234495 | A1* | 8/2017 | Zaderej | F21S 8/04 362/296.01 |

* cited by examiner

UTILIZATION OF LIGHTING POWER INFRASTRUCTURE

CROSS REFERENCE TO RELATED APPLICATIONS

The present application claims priority under 35 U.S.C. Section 119(e) to U.S. Provisional Patent Application No. 62/371,072, filed Aug. 4, 2016 and titled "Utilization Of Lighting Power Infrastructure," the entire content of which is incorporated herein by reference.

TECHNICAL FIELD

The present disclosure relates generally to electrical power utilization, and more particularly to utilizing existing lighting power infrastructure for powering devices and systems that are unrelated to lighting.

BACKGROUND

Light emitting diode (LED) lighting fixtures generally consume significantly less energy than higher powered non-led counterparts. For example, LED lighting fixtures generally consume between 50%-90% less energy than higher power non-LED counterparts. As lighting fixtures are retrofitted with LEDs and LED-based light sources, existing power infrastructures used to provide power to the lighting fixtures become underutilized.

With the availability of low cost, high speed wireless connectivity and microprocessors, and the desire for connected systems, systems with smart devices are becoming more widely available. Some of these systems overcome challenges related to wiring and access to power by using wireless communication and batteries to provide power. Some systems, such as audio, visual, and other systems that rely on streaming communication, require power from fixed installations because charging and limited periods of power availability are not acceptable. Low cost, high speed wireless internet connectivity, microprocessors, and digital streaming methods combined with continually increasing availability of small, high quality audio and video equipment have dramatically increased the desire and expectation for distributed non-lighting devices and systems that require stable power.

Thus, a solution that enables utilizing existing power infrastructure of retrofitted lighting fixtures to provide power to other devices that are unrelated to lighting devices and systems is desirable.

SUMMARY

The present disclosure relates to utilizing existing lighting power infrastructure for powering devices and systems that are unrelated to lighting. In an example embodiment, a lighting module includes an LED light source and a power source coupled to the LED light source. The LED light source is powered by the power source. The power source includes an auxiliary output connection that is terminated at a standardized connector. The power source provides power to an auxiliary device via the standardized connector.

In another example embodiment, a lighting fixture includes an LED light source, a power source coupled to the LED light source, and a housing. The LED light source and the power source are disposed inside the housing. The LED light source is powered by the power source. The power source includes an auxiliary output connection that is terminated at a standardized connector. The power source provides power to an auxiliary device via the standardized connector.

In another example embodiment, a system of lighting and auxiliary devices includes a lighting fixture that includes an LED light source and a power source coupled to the LED light source. The LED light source is powered by the power source. The power source includes an auxiliary output connection that is terminated at a standardized connector. The system further includes an auxiliary device coupled to the standardized connector. The power source provides power to the auxiliary device via the standardized connector.

These and other aspects, objects, features, and embodiments will be apparent from the following description and the claims.

BRIEF DESCRIPTION OF THE FIGURES

Reference will now be made to the accompanying drawings, which are not necessarily drawn to scale, and wherein.

Figure 1:
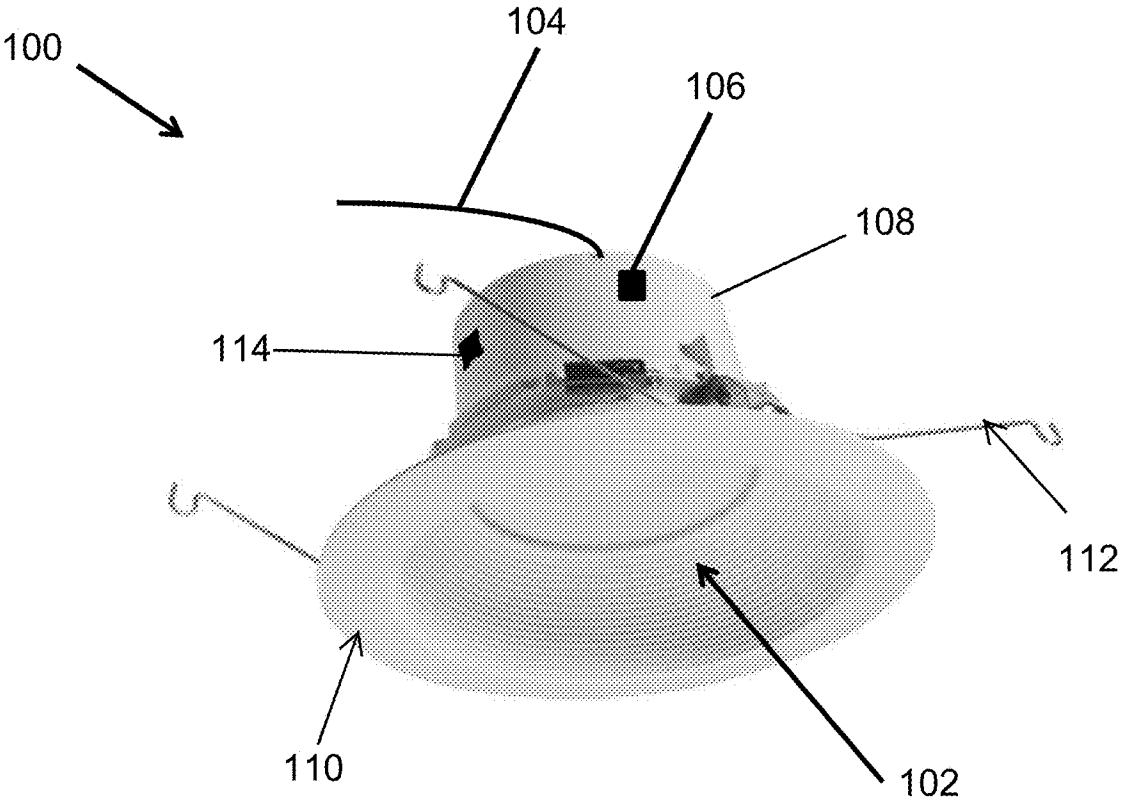
FIG. 1 illustrates a lighting module of a lighting fixture according to an example embodiment.

The drawings illustrate only example embodiments and are therefore not to be considered limiting in scope. The elements and features shown in the drawings are not necessarily to scale, emphasis instead being placed upon clearly illustrating the principles of the example embodiments. Additionally, certain dimensions or placements may be exaggerated to help visually convey such principles. In the drawings, the same reference numerals that are used in different drawings designate like or corresponding, but not necessarily identical elements.

DETAILED DESCRIPTION OF THE EXAMPLE EMBODIMENTS

In the following paragraphs, example embodiments will be described in further detail with reference to the figures. In the description, well known components, methods, and/or processing techniques are omitted or briefly described. Furthermore, reference to various feature(s) of the embodiments is not to suggest that all embodiments must include the referenced feature(s).

Light fixtures are distributed throughout buildings and often throughout individual rooms. As existing lighting fixtures are retrofitted with more energy efficient light sources such as LED light sources or replaced by LED lighting fixtures, the existing power infrastructure that is designed for the original lighting fixtures becomes underutilized. In some cases, utilization of the existing power infrastructure may be increased by using a power source (e.g., a driver) of a lighting fixture to provide power to the LED lighting fixture as well as to other non-lighting related devices (e.g., wireless speakers, etc.). The power source can provide power to other devices (i.e., non-lighting devices)

such as audio and/or visual system devices using a standardized connector such as USB, micro USB, RJ45, and other standardized DC power connectors (e.g., sockets), thus allowing non-lighting devices to be connected and powered after installation of a lighting fixture. To illustrate, a recessed lighting fixture that is recessed in a ceiling may have a standardized power connector to allow a wirelessly controlled audio and/or visual device (e.g., an amplifier) to be installed behind a ceiling.

In general, a system for utilizing a lighting power infrastructure may include a power source/supply that is integral to a lighting fixture and that provides power to the LED light source of the lighting fixture as well as to other auxiliary device(s) that operate on low voltage DC power. The power source may provide power to the auxiliary devices via one or more of standardized connectors, such as USB, micro USB, or RJ45. A standardized connector that is used in providing power to an auxiliary device may be accessible from within a housing of the LED lighting fixture, for example, through an opening (e.g., with an access door or panel) of the housing.

In some example embodiments, the lighting fixture may include a wireless communication system for use in the control of the lighting fixture and for monitoring of the power source. For example, in some cases, the power source may include wireless communication circuitry for wirelessly controlling the lighting fixture and for monitoring the power source. To illustrate, a control pad (e.g., a keypad installed in a wall) may be used for lighting control by wirelessly communicating with the lighting fixture (e.g., with the power source). The control pad may also be used to control operation of the auxiliary device(s) (e.g., low voltage accessories such as speakers, cameras, and/or sensors) powered by the power source of the lighting fixture via the standardized connector(s).

Turning now to the figures, particular example embodiments are described. FIG. 1 illustrates a lighting module 100 of a lighting fixture according to an example embodiment. In some example embodiments, the lighting module 100 includes an LED light source 102, a cover 108, and a trim 110. The lighting fixture 100 may also include attachment structures such as torsion springs 112 for attaching the lighting module 100 to a housing of a lighting fixture.

In some example embodiments, the LED light source 102 may include discrete LEDs, organic light-emitting diodes (OLEDs), an LED chip on board that includes discrete LEDs, or an array of discrete LEDs. Power may be provided from an AC power supply such as a mains power supply of a building to power the LED light source 102 of the lighting module 100. The AC power may be provided to the lighting module 100 via a connection (electrical wires) 104. To illustrate, the lighting module 100 may include a power source (shown in FIG. 2) that receives the AC power from the AC power source and that provides power to the LED light source 102 generated from the AC power.

In some example embodiments, the lighting module 100 may include a standardized DC connector 106 for providing DC power to an auxiliary device. For example, the standardized connector 106 may be one of a Universal Serial Bus (USB) connector, a micro USB connector, an RJ45 connector, or another standardized DC power connector. In some example embodiments, the standardized connector 106 may include two or more connectors/ports of the same type or different types. To illustrate, the standardized connector 106 may include a USB port/connector (e.g., a USB socket) and an RJ45 connector/port (e.g., socket) or another permutation of different types of connectors. As another example, the standardized connector 106 may include two USB connectors or two or more of another type of connectors.

In some example embodiments, the power source of the lighting module 100 may provide power to the LED light source 102 at a power level that is appropriate to the LED light source 102 and may also provide power to an auxiliary device that is connected to the standardized connector 106. The power source of the lighting module 100 may provide power to one or more auxiliary devices that are connected to the connector 106 at power levels appropriate to the auxiliary devices.

In some example embodiments, the light module 100 may include a second connector/port 114 that can be used to provide power to an auxiliary non-lighting device. For example, the connector 114 may be a standardized connector, such as a USB connector, a micro USB connector, an RJ45 connector, etc. that can be used in a similar manner as described with respect to the standardized connector 106. In some alternative embodiments, the connector 114 may include multiple ports that are of the same or different type from each other. In some alternative embodiments, the connector 114 may be omitted without departing from the scope of this disclosure.

By using the connector 106, an existing lighting power infrastructure can be used to provide power to auxiliary devices without the need to install a new power infrastructure to support the auxiliary devices. The existing electrical connection 104 can be used without the need to install new wiring to provide power to auxiliary devices such as speakers, cameras, sensors, etc. The existing lighting power infrastructure that would otherwise be severely underutilized can be more effectively used by providing power to devices that are not used in providing lighting.

In some alternative embodiments, the standardized connector 106 may be positioned at a different location than shown in FIG. 1 without departing from the scope of this disclosure. Further, the lighting module 100 may include more than one standardized connector 106. Further, the lighting module 100 may have a different shape and configuration of components than shown in FIG. 1 without departing from the scope of this disclosure. For example, the cover 108 and the trim 110 may have different shapes than shown in FIG. 1. In some alternative embodiments, one or more components of the light module 100 may be omitted without departing from the scope of this disclosure. Although the lighting module 100 is described as including the LED light source 102, in some alternative embodiments, the lighting module 100 may include another low power light source instead of or in addition to the LED light source 102 without departing from the scope of this disclosure.

Figure 2:
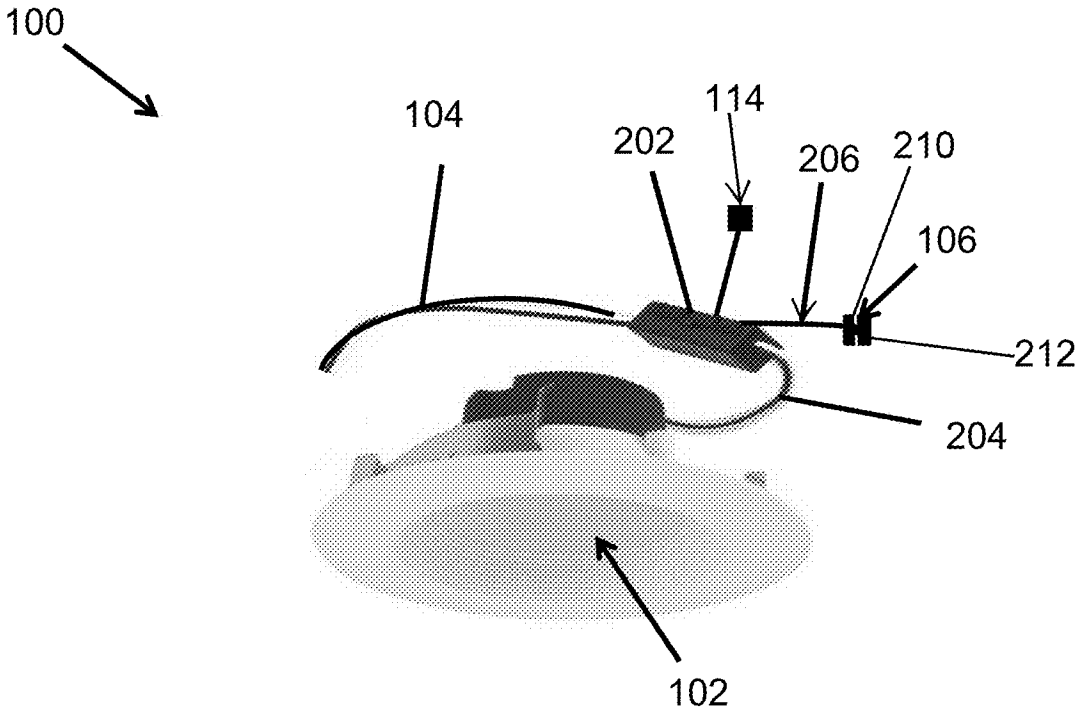
FIG. 2 illustrates the lighting module of FIG. 1 without a cover according to an example embodiment.

FIG. 2 illustrates the lighting module 100 of FIG. 1 without the cover 108 according to an example embodiment. Referring to FIGS. 1 and 2, the lighting module 100 may include a power source 202 (e.g., an LED driver). The power source 202 may receive AC power from an AC power supply, such as a mains power supply, and provide power (e.g., DC power) to the LED light source 102 via a connection (electrical wire(s)) 204. The power source 202 may also provide power to one or more auxiliary devices that may be connected to the standardized connector 106. As illustrated in FIG. 2, an electrical connection 206 (i.e., one or more electrical wires) that is coupled to the power source 202 is terminated at the standardized connector 106, that can provide standardized connection capability that reduces installation time and cost of auxiliary devices, for example, behind a ceiling. The connection 206 may be connected to the power source 202 by a connector, or alternatively, may be connected inside the power source 202 by other means. In some example embodiments, the connector 106 may include two or more standardized connectors/ports 210, 212, such as USB connectors, micro USB connectors, RJ45 connectors, another type of connector, or a combination thereof.

To illustrate, the power source 202 may include one or more AC/DC converters to generate DC power from the AC power provided to the power source 202 via the connection 104. The power source 202 provides the appropriate amount of power to the LED light source 102. The power source 202 also provides an appropriate amount of power to a device that is coupled to the standardized connector 106. For example, the power source 202 may generate a 5-Volt output when the standardized connector 106 is a USB connector.

In some example embodiments, the power source 202 provides DC power to the LED light source 102 and to one or more auxiliary devices connected to the standardized connector 106 at different voltage levels. For example, the auxiliary devices that are connected to the standardized connector 106 may be low voltage devices that operate on relatively lower voltage levels compared to the voltage level provided to the LED light source 102.

In some alternative embodiments, the power source 202 may receive DC power instead of AC power and provide DC power levels appropriate to the LED light source 102 and to one or more auxiliary devices that may be connected to the standardized connector 106. For example, the power source 202 may receive the DC power from a DC power source via the connection 104. The power source 202 may include one or more DC/DC converters that generate appropriate DC power levels from the input DC power received from the DC power source.

In some example embodiments, the power source 202 also provides DC power to one or more auxiliary devices connected to the connector 114. For example, the power provided by the power source 202 at the connector 114 may be at a different voltage level than the power provided to the LED light source 102 and/or at the standardized connector 106. In some alternative embodiments, the connector 114 may include multiple ports that are of the same or different type from each other. In some alternative embodiments, the connector 114 may be omitted without departing from the scope of this disclosure.

In some example embodiments, the power source 202 may include a wireless transmitter and receiver to wirelessly communicate with a control device such as a wall-mounted control pad. Alternatively, the lighting module 100 may include a wireless transmitter and receiver outside of the power source 202 to wirelessly communicate with a control device. The wireless transmitter and receiver may send and receive wireless signals that are compliant with wireless communication standards such as Wi-Fi and Bluetooth. Alternatively, the wireless transmitter and receiver may send and receive wireless signals that are compliant with a proprietary protocol.

Figure 3:
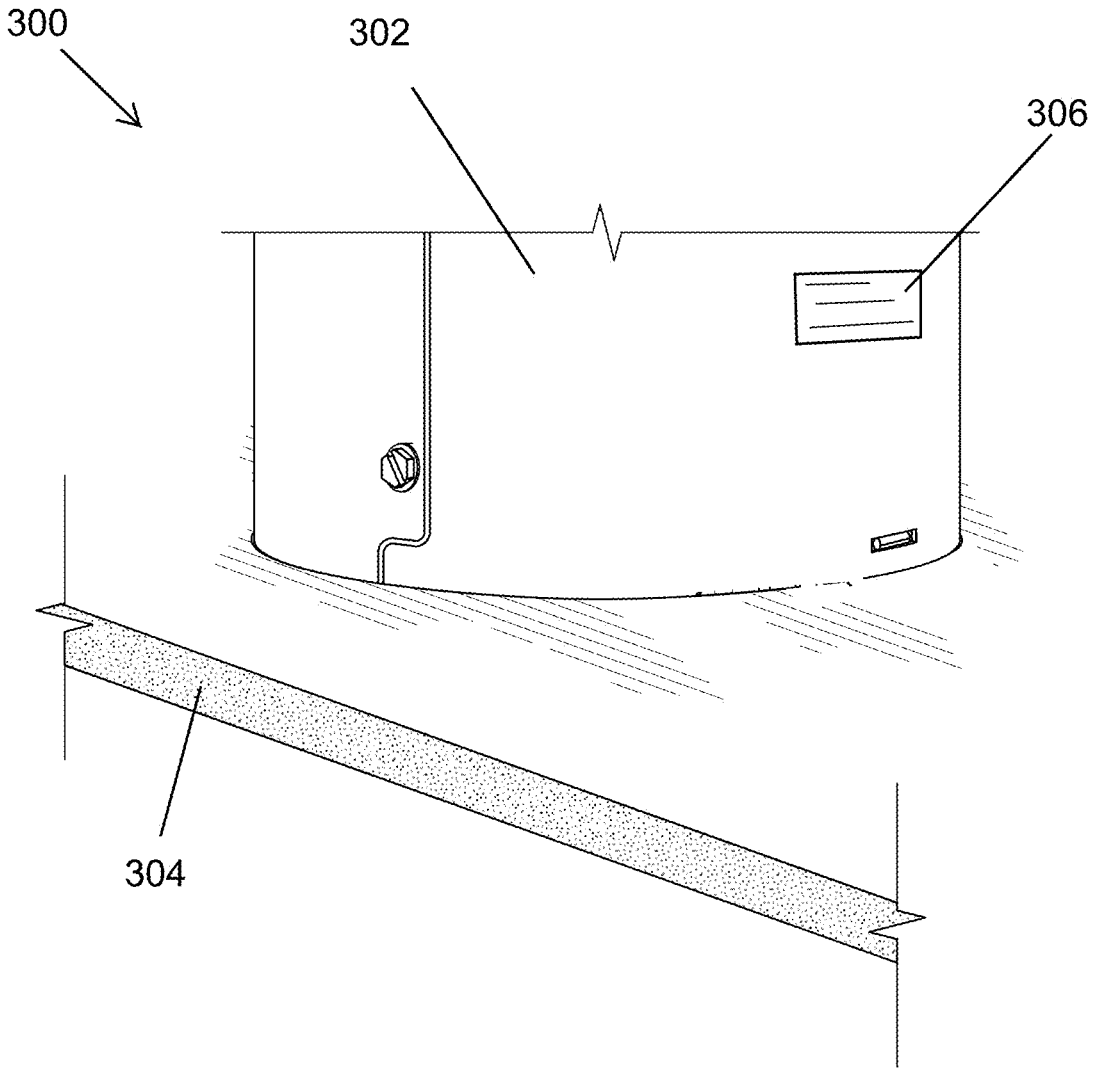
FIG. 3 illustrates a lighting fixture including the lighting module of FIG. 1 according to an example embodiment.

FIG. 3 illustrates a lighting fixture according to an example embodiment. In some example embodiments, the lighting fixture 300 may include the light module 100 of FIGS. 1 and 2. Referring to FIGS. 1-3, in some example embodiments, the lighting fixture 300 may be recessed in a ceiling 304. To illustrate, the lighting fixture 300 may include a housing 302 having a cavity, and the lighting module 100 may be positioned in the cavity of the housing 302. For example, the lighting module 100 may be installed within the housing 302 using attachment structures 112 shown in FIG. 1 and respective receiving structures inside the housing 302.

In some example embodiments, the housing 302 of the lighting fixture 300 may be an existing housing that is retrofitted with the lighting module 100. Alternatively, the housing 302 may be part of the lighting fixture 300 that is installed as a replacement of another lighting fixture that has been removed. The housing 302 may have an opening 306 to provide access to the lighting module 100 positioned within the housing 302. To illustrate, the standardized connector 106 may be accessible through the opening 306 in the wall of the housing 302.

For example, a connector designed to mate with the standardized connector 106 may be extended through the opening 306 to inside the housing 302 for connection with the standardized connector 106. For example, the mating connector may be connected to an electrical wire(s) from an auxiliary device to be powered by the power source 202 of the lighting fixture 300. Alternatively, the standardized connector 106 may extend out of the housing 302 through the opening 306 for connection with the mating connector. In some example embodiments, the housing 302 may include an access door or panel that is used to cover the opening 306, for example, when the standardized connector 106 is unused.

Although the housing 302 is shown as having a particular shape, in alternative embodiments, the housing 302 may have other shapes without departing from the scope of this disclosure. Further, the opening 306 may be at a different location than shown in FIG. 3 without departing from the scope of this disclosure. The opening 306 may also have a different shape and size than shown in FIG. 3 without departing from the scope of this disclosure. In some alternative embodiments, the power source 202 may be outside of the housing 302. In some example embodiments, an auxiliary device may be disposed inside the housing 302.

Figure 4:
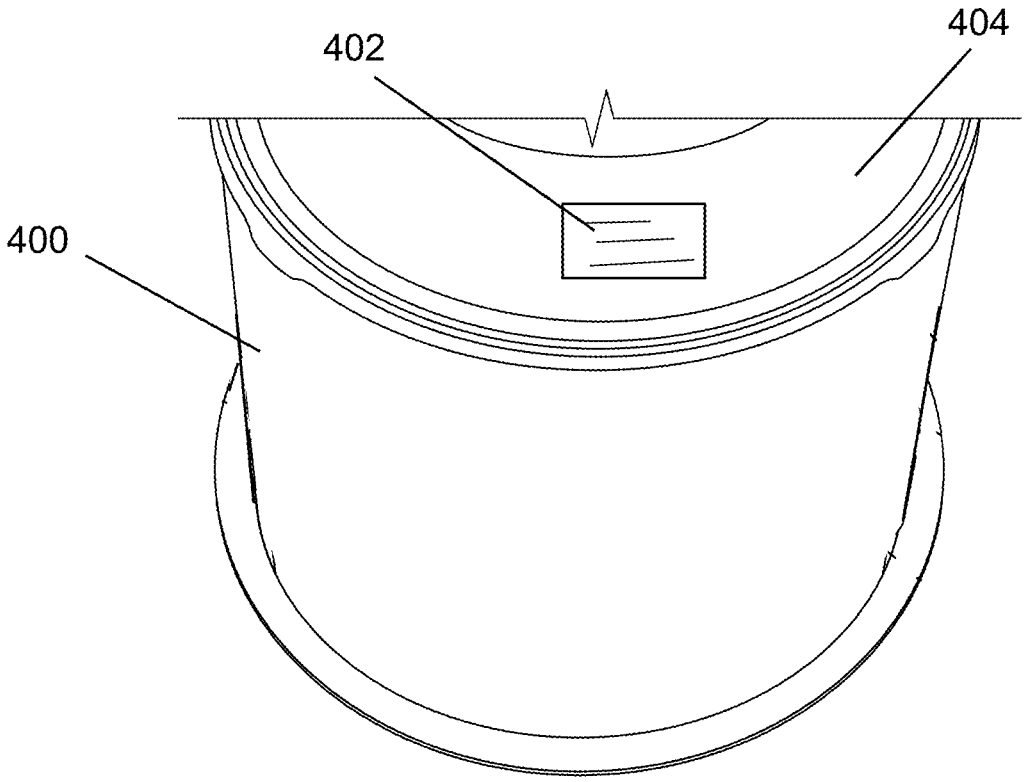
FIG. 4 illustrates a housing of the lighting fixture of FIG. 3 according to another example embodiment.

FIG. 4 illustrates a housing 400 of a lighting fixture according to another example embodiment. Referring to FIGS. 1, 2, and 4, the housing 400 may be used in a lighting fixture similar to the lighting fixture 300 of FIG. 3 that includes the light module 100 that is positioned in a cavity of the housing 400. In some example embodiments, the housing 400 may have an opening 402 formed in a top cover 404 of the housing 400. The opening 402 may be used to provide access to the power source (e.g., a driver) of the lighting module 100 positioned within the housing 400 in a similar manner as described with respect to the opening 306 of the housing 302 shown in FIG. 3.

To illustrate, the standardized connector 106 may be accessible through the opening 402. For example, a connector terminating one or more electrical wires from one or more auxiliary devices and that mates with the standardized connector 106 may pass through the opening 402 to inside of the housing 400 for connection with the standardized connector 106. Alternatively, the standardized connector 106 may extend out of the housing 400 through the opening 402 for connection with one or more mating connectors of one or more auxiliary devices such as a speaker, a camera, a sensor, etc. In some example embodiments, the housing 400 may include an access door or panel that is used to cover the opening 402 when the standardized connector 106 is not used to provide power to an auxiliary device that is external to the housing.

Although the housing 400 is shown to have a particular shape, in alternative embodiments, the housing 400 may have other shapes without departing from the scope of this disclosure. Further, the opening 402 may be at a different location than shown in FIG. 4 on the top cover 404 of the housing 400 without departing from the scope of this disclosure. The opening 402 may also have a different shape and size than that shown in FIG. 4 without departing from the scope of this disclosure.

Figure 5:
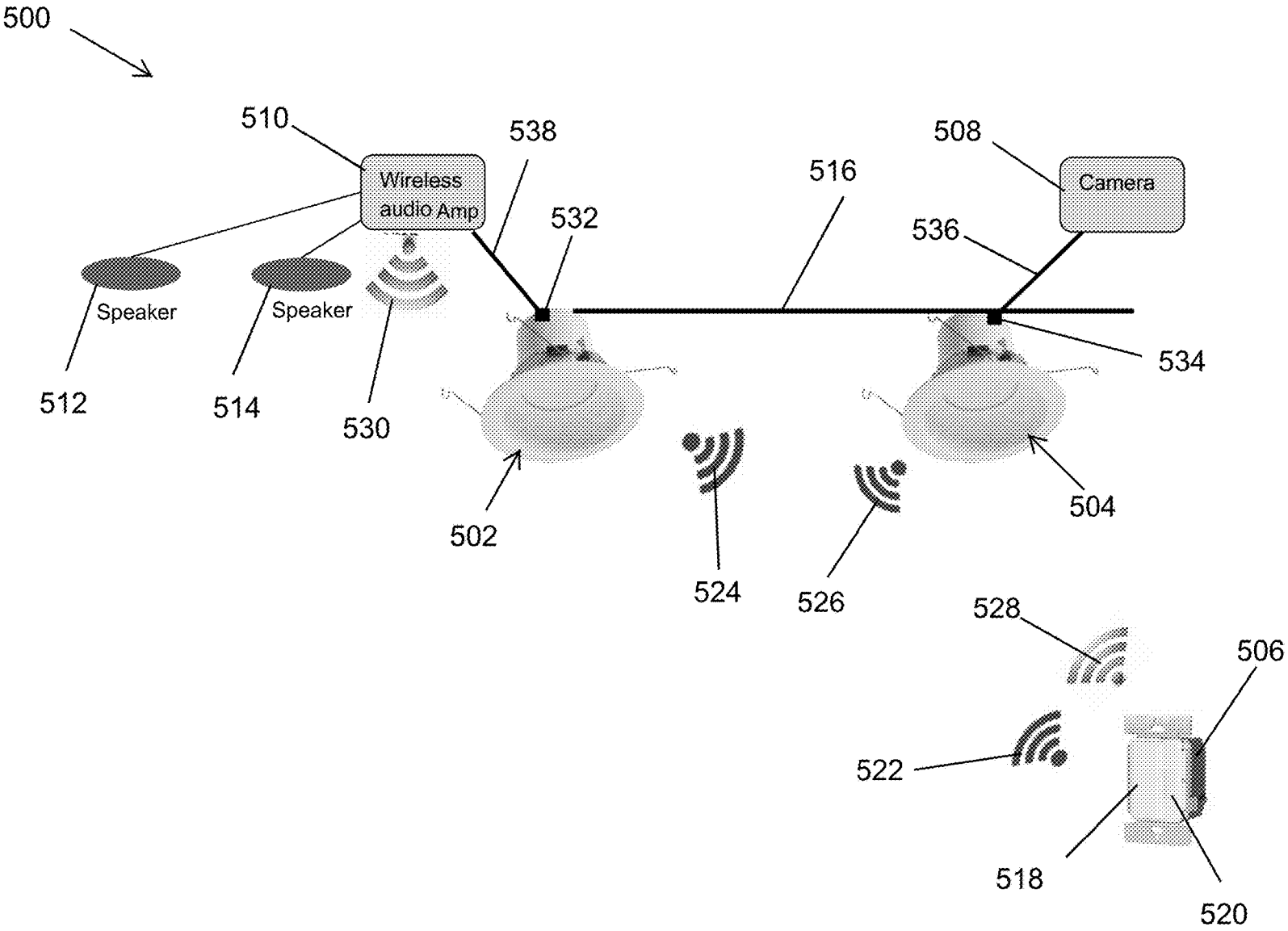
FIG. 5 illustrates a system of lighting and non-lighting devices that utilize an existing power infrastructure according to an example embodiment.

FIG. 5 illustrates a system 500 of lighting and non-lighting devices that utilize an existing power infrastructure according to an example embodiment. In some example embodiments, the system 500 includes lighting modules 502, 504, a camera 508, and a wireless audio amplifier 510. For example, the light modules 502, 504 may be instances of the light module 100 shown in FIGS. 1 and 2. To illustrate, the lighting modules 502, 504 may be integrated in a lighting fixture such as the lighting fixture 300 of FIG. 3 and may be inside the housing 302, the housing 400, or another housing.

In some example embodiments, a power connection 516 (e.g., electrical wires) that may be part of an existing power infrastructure is used to provide AC power to each power source of the lighting modules 502, 504. For example, the power connection 516 may be connected to the mains power of a building. In some example embodiments, the power connection 516 may be connected to the mains power through a switch, such as a wall-mounted switch. For example, the power connection 516 may have been previously used to provide power to one or more lighting fixtures that are now low power lighting fixtures.

In some example embodiments, the camera 508 may be powered by the power source of the lighting module 504 via an electrical connection 536 (e.g., an electrical cable) connected to a standardized connector 534 of the lighting module 504. For example, the camera 508 may require a 5-Volt DC power signal, and the power source of the lighting fixture 604 may generate a 5-Volt power signal from the AC power received via the connection 516. To illustrate, the standardized connector 534 may be a standardized DC power jack with a center positive or center negative terminal. As another example, the standardized connector 534 may be an RJ45 socket that receives an RJ45 plug of the connection 536 that is, for example, a CAT-5 cable used to provide power to the camera 508. Alternatively, the standardized connector 534 may be a USB, mini USB, or a micro USB connector that is designed to receive a matching connector of the connection 536. As another example, the camera 508 may require a DC voltage level that is more or less than 5 volts, and the power source of the lighting fixture 504 may provide the appropriate voltage level to the camera 508 in a similar manner as described above. The camera 508 may transmit images and/or video, for example, to a central control device wirelessly or via a wired connection.

In some example embodiments, the audio amplifier 510 may be powered by the power source of the lighting module 502 via a connection 538 (e.g., an electrical cable) that is connected to a standardized connector 532 of the lighting module 502. For example, the amplifier 510 may require a 12-Volt DC input power, and the power source of the lighting fixture 502 may provide a 12-Volt DC power signal to the amplifier 510. As another example, the amplifier 510 may require a voltage level that is more or less than 12 volts, and the power source of the lighting fixture 502 may provide the particular voltage level required by the amplifier 510.

In some example embodiments, the standardized connector 532 may be a standardized DC power jack with a center positive or center negative terminal. As another example, the standardized connector 532 may be an RJ45 socket that receives an RJ45 plug of the connection 538 that is, for example, a CAT-5 cable. In some alternative embodiments, the standardized connector 532 may be a USB, mini USB, a micro USB, or another type of connector that mates with a matching connector connected to the connection 538.

In some example embodiments, the audio amplifier 510 may be coupled to speakers 512, 514 as part of an audio system. The audio amplifier 510 may be capable of wirelessly communicating with a control device. For example, the audio amplifier 510 may include wireless communication circuitry to transmit and receive wireless signals. To illustrate, the audio amplifier 510 may be wirelessly controllable to adjust the volume and other aspects (e.g., treble, bass, etc.) of the sound produced by the speakers 512, 514. The audio amplifier 510 may receive the audio signal that is output by the speakers 512, 514 wirelessly or via a wired connection.

In some example embodiments, the system 500 may include a control pad 506 to remotely control the lighting modules 502, 504. The control pad 506 may also remotely control the wireless audio amplifier 510. For example, each lighting module 502, 504 may include wireless communication circuitry as described above with respect to the lighting module 100.

In some example embodiments, the control pad 506 may be a wall-mounted control pad. That may include a keypad and/or a display. The control pad 506 may include a lighting control interface 518 to remotely control the lighting modules 502, 504. The control pad 506 may also include an auxiliary device control interface 520 to remotely control the wireless audio amplifier 510. To illustrate, the control pad 506 may include wireless communication circuitry to wirelessly communicate with the lighting modules 502, 504 and with the audio amplifier 510. For example, the control pad 506 may transmit wireless signals 522 and receive wireless signals 524, 526 to communicate with the lighting modules 502, 504. The wireless signals 524, 526 may be transmitted by the lighting module 502 and the lighting module 504, respectively. The wireless signals 522, 524, 526 may be compliant with a wireless communication standard, such as Wi-Fi and Bluetooth, or may be based on a proprietary RF communication protocol. The wireless signals 522, 524, 526 may be signals used in a particular wireless communication network such as a Wi-Fi network.

In some example embodiments, the control pad 506 may also transmit wireless signals 528 and receive wireless signals 530 to communicate with the wireless audio amplifier 510. For example, the control pad 506 may be used to control operations of the wireless audio amplifier 510. To illustrate, the volume and other aspects of the sound produced by the speakers 512, 514 may be remotely controlled/adjusted using the control pad 506. The wireless signals 528, 530 may be compliant with a wireless communication standard, such as Wi-Fi and Bluetooth, or may be based on a proprietary RF communication protocol. The wireless signals 528, 530 may be signals used in a particular wireless communication network that is the same as or different from the wireless communication network of the signals 522, 524, 526. In some example embodiments, the network of the wireless signals 528, 530 may be a higher bandwidth network than the network of wireless signals 522, 524, 526 to support devices that perform audio and/or video streaming. In some example embodiments, the camera 508 may also wirelessly communicate with a control device such as the control pad 506.

By using existing power infrastructure to provide power to the camera 508 and the amplifier 510, cost associated with installing new wiring can be avoided. The capability of the existing infrastructure to provide more power than required by the light modules 502, 504 can also be more fully utilized.

In some example embodiments, the connector 532 may include one or more other ports (e.g., a USB or RJ45 socket) that allow one or more other devices to be connected to and powered by the power source of the lighting fixture 502. In some example embodiments, the connector 534 may include one or more other ports (e.g., a USB or RJ45 socket) that allow one or more other devices to be connected to and powered by the power source of the lighting fixture 504.

In some alternative embodiments, the control pad 506 may be two separate control pads, each dedicated to one or the other of the lighting modules 502, 504 and the audio amplifier 510. In some alternative embodiments, the system 500 may include fewer or more lighting modules, cameras, audio amplifiers and other components than shown in FIG. 5 without departing from the scope of this disclosure. The system 500 may also include other auxiliary devices instead of or in addition to the camera 508 and the audio amplifier 510. In some example embodiments, the camera 508 and/or other auxiliary devices may be controlled remotely using wireless signals in a similar manner as described above.

Figure 6:
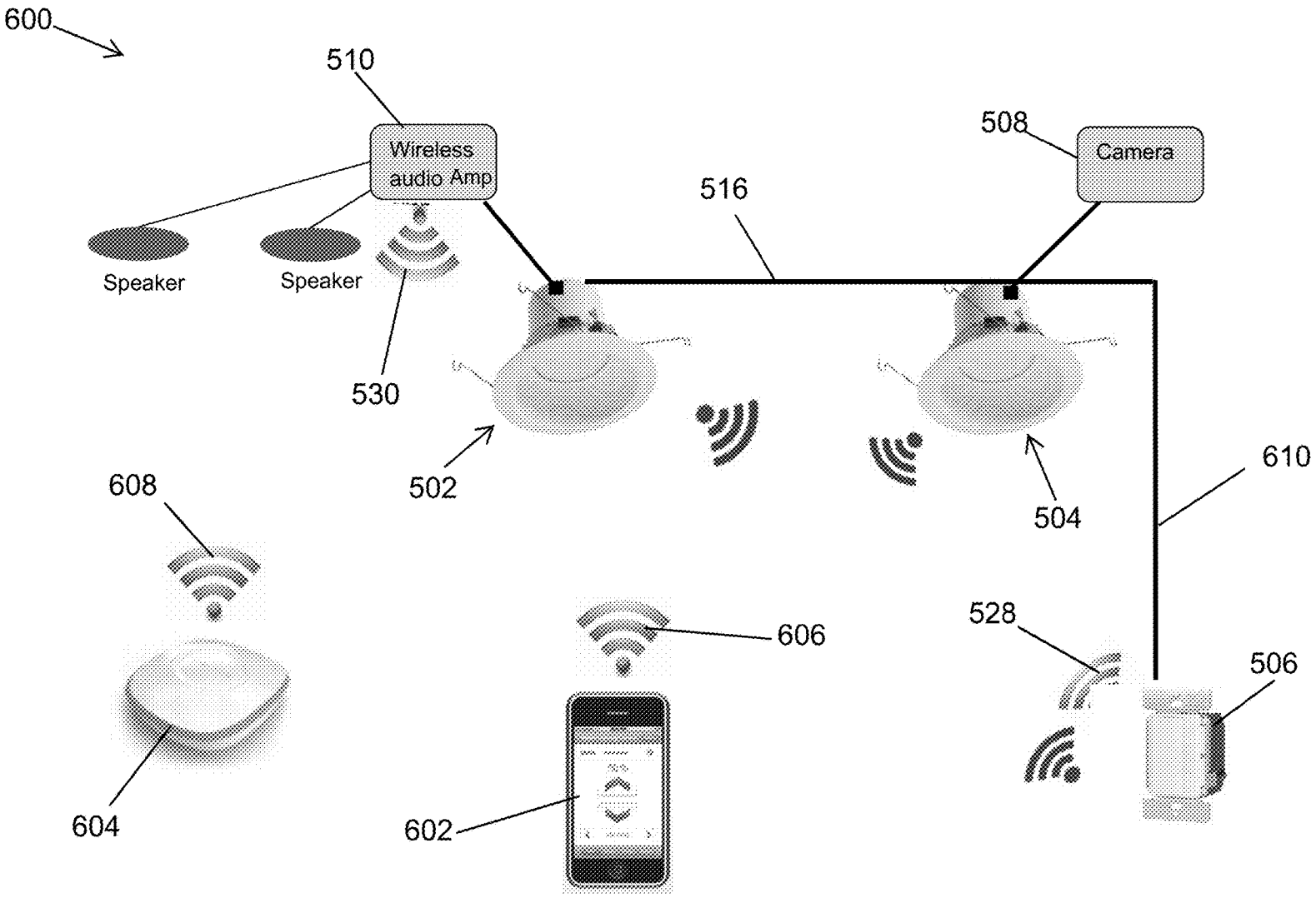
FIG. 6 illustrates a system including the lighting and non-lighting devices of FIG. 5 according to another example embodiment.

FIG. 6 illustrates a system 600 of lighting and non-lighting devices that utilize an existing power infrastructure according to another example embodiment. In some example embodiments, the system 600 includes the light modules 502, 504, the camera 508, and the amplifier 510 that may be connected as described above with respect to the system 500 of FIG. 5. In some example embodiments, the system 600 also includes wireless communication devices 602, 604. For example, the mobile device 602 may be used to control the audio amplifier 510.

In some example embodiments, the wireless communication device 602 may be a handheld mobile device that transmits and receives wireless signals. For example, the wireless communication device 602 may wirelessly communicate with the wireless audio amplifier 510 by transmitting wireless signals 606 and receiving the wireless signals 530. In some example embodiments, the wireless communication device 604 may operate as a wireless router that receives wired and/or wireless signals (e.g., the wireless signals 528, 530) and transmits wireless signals 608, for example, to the audio amplifier 510 and/or to other devices of the system 600. The wireless signals 606, 608 may be compliant with a wireless communication standard, such as Wi-Fi or Bluetooth, or may be based on a proprietary wireless communication protocol. The wireless signals 606, 608 and the wireless signals 522, 524, 526, 528 may be used in the same wireless network or in different wireless networks.

In some example embodiments, an electrical connection 610 (e.g., one or more electrical wires) that is part of the existing power infrastructure and connected to the connection 516 may be used for wired control of the lighting modules 502, 504 from the control pad 506. Alternatively, the electrical connection 610 may be no longer used.

Although particular embodiments have been described herein in detail, the descriptions are by way of example. The features of the example embodiments described herein are representative and, in alternative embodiments, certain features, elements, and/or steps may be added or omitted. Additionally, modifications to aspects of the example embodiments described herein may be made by those skilled in the art without departing from the spirit and scope of the following claims, the scope of which are to be accorded the broadest interpretation so as to encompass modifications and equivalent structures.

What is claimed is:

1. A lighting module for use in a recessed lighting fixture, the lighting module comprising:

a light emitting diode (LED) light source; and a power source coupled to the LED light source, wherein the LED light source is powered by the power source, wherein the power source includes an auxiliary output connection that is terminated at a standardized connector, wherein the power source provides power to an auxiliary device via the standardized connector, wherein the standardized connector includes an RJ45 connector, and wherein the standardized connector is located such that the standardized connector is entirely inside a lighting fixture housing of the recessed lighting fixture when the lighting module is positioned in the lighting fixture housing.

2. The lighting module of claim 1, wherein the power source receives an alternating current (AC) power and outputs a first direct current (DC) power provided to the LED light source and a second DC power available at the standardized connector.

3. The lighting module of claim 2, wherein the first DC power is provided to the LED light source at a first voltage level and wherein the second DC power is available at the standardized connector at a second voltage level that is different from the first voltage level.

4. The lighting module of claim 1, wherein the auxiliary output connection is terminated at a second standardized connector.

5. The lighting module of claim 1, wherein the standardized connector includes a USB socket.

6. A recessed lighting fixture, comprising:

a light emitting diode (LED) light source;

a power source coupled to the LED light source; and a housing, wherein the LED light source and the power source are disposed inside the housing, wherein the LED light source is powered by the power source, wherein the power source includes an auxiliary output connection that is terminated at a standardized connector, wherein the power source provides power to an auxiliary device via the standardized connector, wherein the standardized connector includes an RJ45 socket, and wherein the standardized connector is located entirely inside the housing and at a back side of a ceiling when the recessed lighting fixture is installed recessed in the ceiling.

7. The recessed lighting fixture of claim 6, wherein the power source receives an alternating current (AC) power and outputs a first direct current (DC) power provided to the LED light source and a second DC power available at the standardized connector.

8. The recessed lighting fixture of claim 7, wherein the first DC power is provided to the LED light source at a first voltage level and wherein the second DC power is available at the standardized connector at a second voltage level that is different from the first voltage level.

9. The recessed lighting fixture of claim 6, wherein the auxiliary output connection includes a termination at a second standardized connector.

10. The recessed lighting fixture of claim 9, wherein the standardized connector and the second standardized connector are a same type of connector.

11. The recessed lighting fixture of claim 9, wherein the standardized connector and the second standardized connector are different types of connectors.

12. The recessed lighting fixture of claim 6, wherein the housing has an opening to provide access to the standardized connector and wherein the opening is located at a back side of the ceiling when the recessed lighting fixture is installed recessed in the ceiling.

13. The recessed lighting fixture of claim 6, wherein the standardized connector includes a USB socket.

14. A system of lighting and auxiliary devices, the system comprising:

a recessed lighting fixture, comprising:

a light emitting diode (LED) light source; and a power source coupled to the LED light source, wherein the LED light source is powered by the power source, wherein the power source includes an auxiliary output connection that is terminated at a standardized connector, wherein the standardized connector includes an RJ45 connector, and wherein the standardized connector is located at a back side of a ceiling hidden from view from below the ceiling when the recessed lighting fixture is installed recessed in the ceiling; and an auxiliary device coupled to the standardized connector by an electrical cable at the back side of the ceiling, wherein the power source provides power to the auxiliary device via the standardized connector.

15. The system of claim 14, wherein the power source receives an alternating current (AC) power and outputs a first direct current (DC) power provided to the LED light source and a second DC power provided to the standardized connector.

16. The system of claim 15, wherein the first DC power is provided to the LED light source at a first voltage level and wherein the second DC power is provided to the auxiliary device at a second voltage level that is different from the first voltage level.

17. The system of claim 14, wherein the standardized connector includes a USB socket.

18. The system of claim 14, wherein the recessed lighting fixture further comprises a housing having an opening to provide access to the standardized connector and wherein the power source is disposed inside the housing.

19. The system of claim 14, wherein the power source includes a second auxiliary output connection that is terminated at a second standardized connector.

20. The system of claim 18, wherein the standardized connector is positioned entirely inside the housing.

* * * * *